US005832565A

United States Patent [19]

Smith

[11] Patent Number: 5,832,565

[45] Date of Patent: Nov. 10, 1998

[54] HINGE ARRANGEMENT FOR MARINE WINDOWS AND OTHER PIVOTING STRUCTURES

[75] Inventor: Ernest Mayo Smith, Sanford, Fla.

[73] Assignee: Water Bonnet Mfg., Inc., Casselberry, Fla.

[21] Appl. No.: 811,731

[22] Filed: Mar. 6, 1997

[51] Int. Cl.[6] ..... E05D 7/04; E05D 5/10

[52] U.S. Cl. ..... 16/235; 16/386

[58] Field of Search ..... 16/235, 342, 243, 16/273, 276, 340, 386, 387, 367, 239, 241; 49/397–399, 382; 403/127

[56] References Cited

U.S. PATENT DOCUMENTS

| | | | |
|---|---|---|---|
| 1,956,040 | 4/1934 | Meyer | 16/340 |
| 3,532,371 | 10/1970 | Ortheil | 403/127 |
| 4,864,690 | 9/1989 | Chen | 16/386 |

FOREIGN PATENT DOCUMENTS

| | | | |
|---|---|---|---|
| 361623 | 10/1922 | Germany | 16/276 |
| 1096723 | 12/1967 | United Kingdom | 16/386 |
| 1196898 | 7/1970 | United Kingdom | 403/127 |
| 1045702 | 10/1996 | United Kingdom | 16/340 |

*Primary Examiner*—Chuck Mah

*Attorney, Agent, or Firm*—James H. Beusse; Holland & Knight LLP

[57] ABSTRACT

A versatile hinge arrangement is disclosed which advantageously prevents binding when multiple hinges are employed on oval or similarly shaped windows such as marine windows. The hinge includes a first hinge member having two arms with aligned central holes for holding a hinge pin in an axially fixed position with respect to the first hinge member. The hinge also includes a second hinge member having a pivot head with a pivot chamber through which passes the portion of the hinge pin between the arms of the first hinge member. The mid portion of the pivot chamber is narrower than the ends of the pivot chamber such that a central pivot is formed at the mid portion of the pivot chamber. In this manner, the first hinge member and the hinge pin attached thereto are permitted to pivot both axially and radially about the central pivot of the second hinge member's pivot chamber. Binding of the hinge as the hinge pivots is thus advantageously avoided.

17 Claims, 5 Drawing Sheets

HINGE ARRANGEMENT FOR MARINE WINDOWS AND OTHER PIVOTING STRUCTURES

BACKGROUND OF THE INVENTION

This invention relates in general to hinges, and more particularly, to hinges for marine windows and other applications using oval-shaped windows or similarly shaped curved windows with angularly oriented frames.

Portholes on ships are typically provided with the familiar oval-shaped marine window. For ventilation purposes or for the passenger's preference, it is often desirable for the marine window to open and close. This requirement presents certain problems in terms of the hinge which must be provided to enable the marine window to swing from the open position to the closed position and vice versa. In a typical design, it is desirable for the oval-shaped marine window to swing vertically up and down about a hinge arrangement which provides a pivot point. If a single hinge is used to provide a pivot point between the edge of the porthole and the marine window, the desired swinging action is achieved. However, it is difficult to properly seal the marine window about its periphery when merely a single hinge is employed between the window and porthole.

When a two hinge arrangement is used to permit a marine window to pivot adjacent the edge of the porthole, the two hinges can bind since their respective pivot axes are not aligned with each other. This binding action undesirably limits the swinging action of the marine window. One solution for this problem is to employ a hinge with a flexible pivot or hinge pin. Unfortunately, such a flexible pin is readily susceptible to breakage with the repeated opening and closing action of the marine window.

Clearly, a superior hinge solution is desired which permits opening and closing of the marine window without causing the hinges to bind and without allowing the hinges to easily break upon repeated use.

SUMMARY OF THE INVENTION

Accordingly, one object of the present invention is to provide a hinge arrangement for a marine window wherein binding of the hinges is avoided.

Another object of the present invention is to provide a hinge arrangement for a marine window which is capable of repeated use without breakage.

In accordance with one embodiment of the present invention, a hinge assembly is provided which includes a hinge pin and a first hinge member for holding the hinge pin in an axially fixed position in the first hinge member. The hinge assembly further includes a second hinge member including a pivot head having a pivot chamber with opposed ends and a mid portion between the opposed ends. The pivot head of the second hinge member is situated extending within the first hinge member such that the hinge pin passes through the pivot chamber of the pivot head. The pivot chamber exhibits a geometry which is narrower toward the mid portion of the pivot chamber than at the opposed ends of the pivot chamber. In this manner, a pivot point is formed at the mid portion of the pivot chamber so that the hinge pin and the first hinge member can pivot radially and axially about the pivot point.

BRIEF DESCRIPTION OF THE DRAWINGS

The features of the invention believed to be novel are specifically set forth in the appended claims. However, the invention itself, both as to its structure and method of operation, may best be understood by referring to the following description and accompanying drawings.

DETAILED DESCRIPTION OF THE INVENTION

Figure 1A:
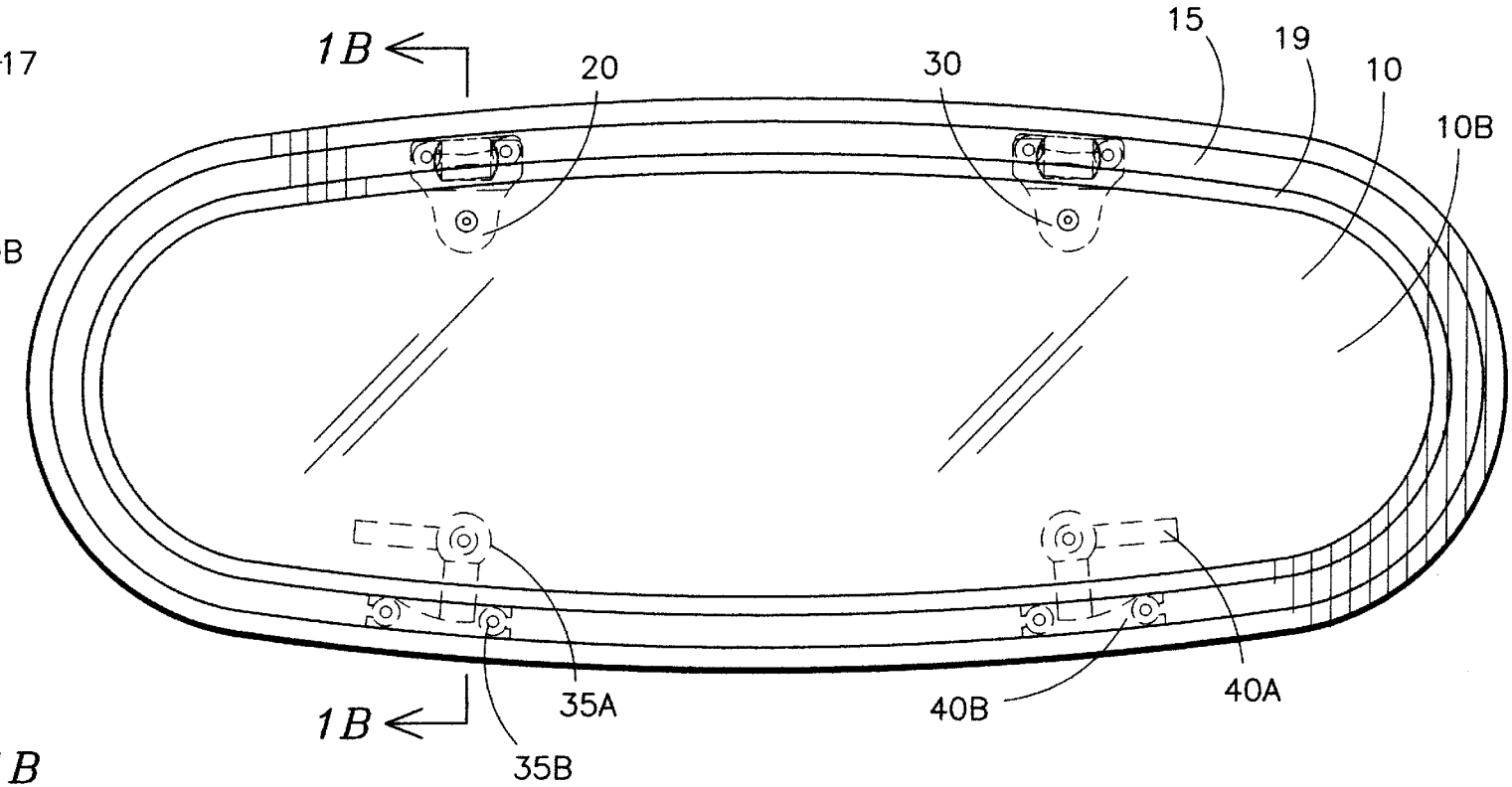
FIG. 1A is a plan view of the exterior of a marine window employing the disclosed hinge assembly.
Figure 1B:
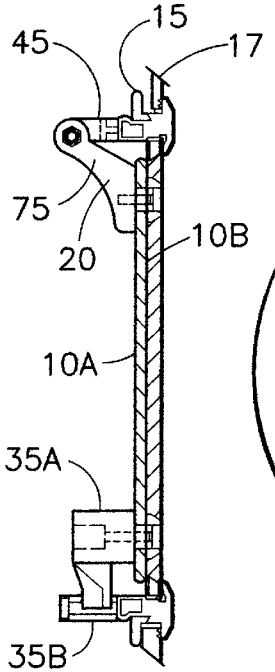
FIG. 1B is a cross sectional view of the window and hinge assembly of FIG. 1A taken along section line 1B—1B.

Referring to the drawings in general and in particular to FIGS. 1A and 1B, FIG. 1A is a plan view of the exterior of a window 10 which is pivotally connected to a window casing or frame 15 by hinge assemblies 20 and 30 while FIG. 1B is a cross section of the window and hinge arrangement of FIG. 1A taken along section line 1B—1B. A hull 17 or other structure within which frame 15 is situated is shown in FIG. 1A. Molding around window 10 is shown as molding 19. Hinge assemblies 20 and 30 are shown in dashed lines to indicate that they are located on the interior of window 10. The interior and exterior surfaces of window 10 are denoted generally as interior surface 10A and exterior surface 10B in the cross section of FIG. 1B. In FIG. 1A, exterior surface 10B faces the observer. Latches 35A and 40A mate with latch receiving members 35B and 40B, respectively, on window frame interior surface 10A to hold window 10 closed as shown.

Hinge assemblies 20 and 30 are substantially the same. For example purposes, only hinge assembly 20 will be discussed in detail. Hinge assembly 20 includes a second hinge member 45 and a first hinge member 75 which mate with each other in a fashion which permits the pivot axis of the hinge assembly to vary angularly as the window opens and closes, i.e., first hinge member 75 is permitted to rotate both axially and radially about second hinge member 45. In this manner, binding of the hinge assemblies is desirably avoided. Typically, the member 45 is attached to a stationary support and member 75 attaches to a moveable structure such as a window.

Figure 2A:
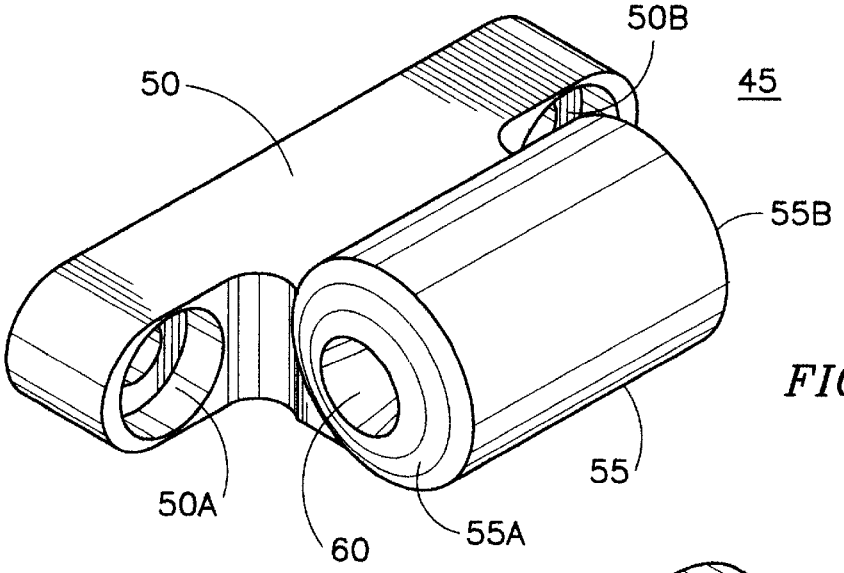
FIG. 2A is a front perspective view of the second hinge member of the hinge assembly.
Figure 2B:
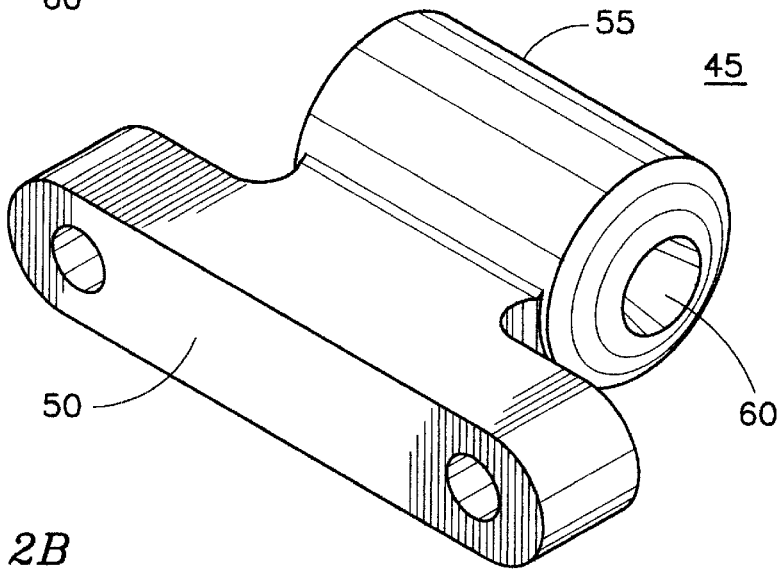
FIG. 2B is a rear perspective view of the second hinge member of the hinge assembly.

More particularly, FIGS. 2A and 2B show front and rear perspective views of second hinge member 45, respectively.

Second hinge member 45 includes a base 50 integrally attached to a substantially cylindrical pivot head 55. Base 50 includes mounting holes 50A and 50B for mounting base 50 to a window frame or other stationary structure in which marine window 10 is to be situated. Appropriate mounting hardware such as screws and corresponding nuts (not shown) are employed to mount marine window 10 to such frame using mounting holes 50A and 50B.

Figure 2C:
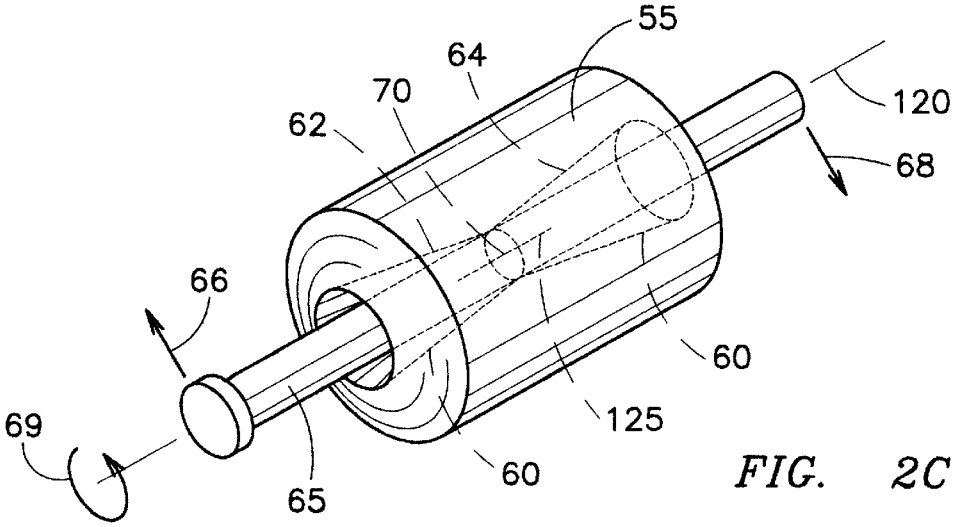
FIG. 2C is a simplified perspective view of the second hinge member showing the hinge pin therein.

Pivot head 55 includes a central pivot chamber 60 which in one embodiment includes substantially cone-shaped chamber sections 62 and 64 as shown in dashed lines in the simplified perspective view of pivot head 55 in FIG. 2C. Pivot head 55 is shaped to permit a hinge pin 65 to angularly rotate within pivot chamber 60 in a direction indicated by arrows 66 and 68 or in direction opposite those indicated, or another angular direction. More particularly, hinge pin 65 pivots angularly about a pivot point 70 at which cone-shaped chamber sections 62 and 64 meet. Hinge pin 65 is free to rotate in virtually any angular direction about pivot point 70 within the constraints of rotation imposed by cone-shaped chamber sections 62 and 64. As will be explained in more detail later, this arrangement permits both axial and radial pivoting of first hinge member 75 with respect to second hinge member 45. Pivot head 55 includes laterally opposed pivot head ends 55A and 55B. In this particular embodiment, pivot head ends 55A and 55B are convexly shaped.

Figure 3A:
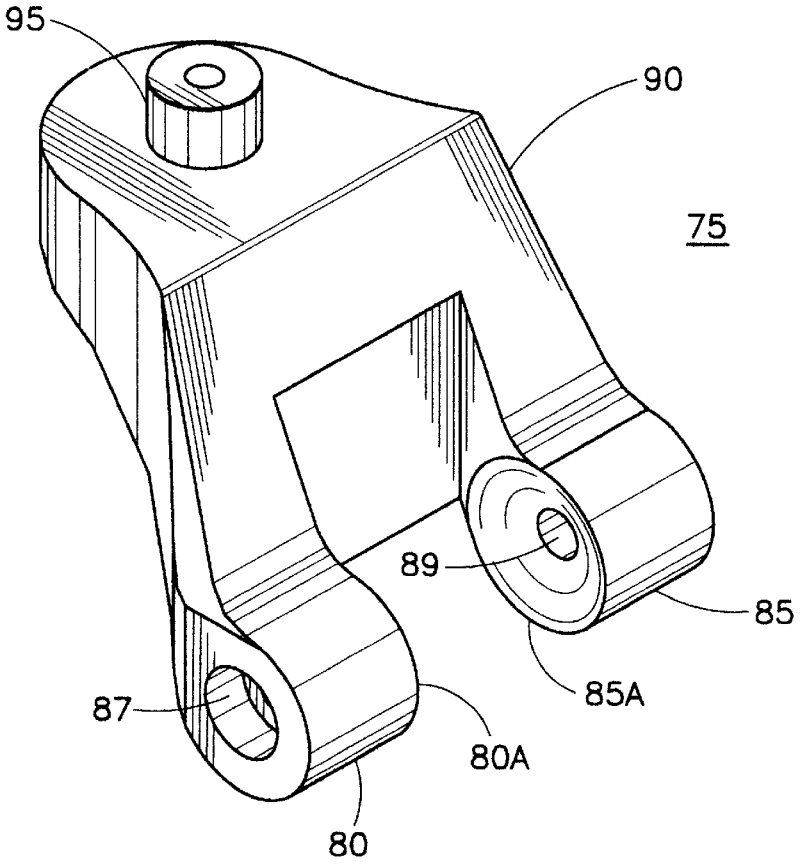
FIG. 3A is a left perspective view of the first hinge member of the hinge assembly.
Figure 3B:
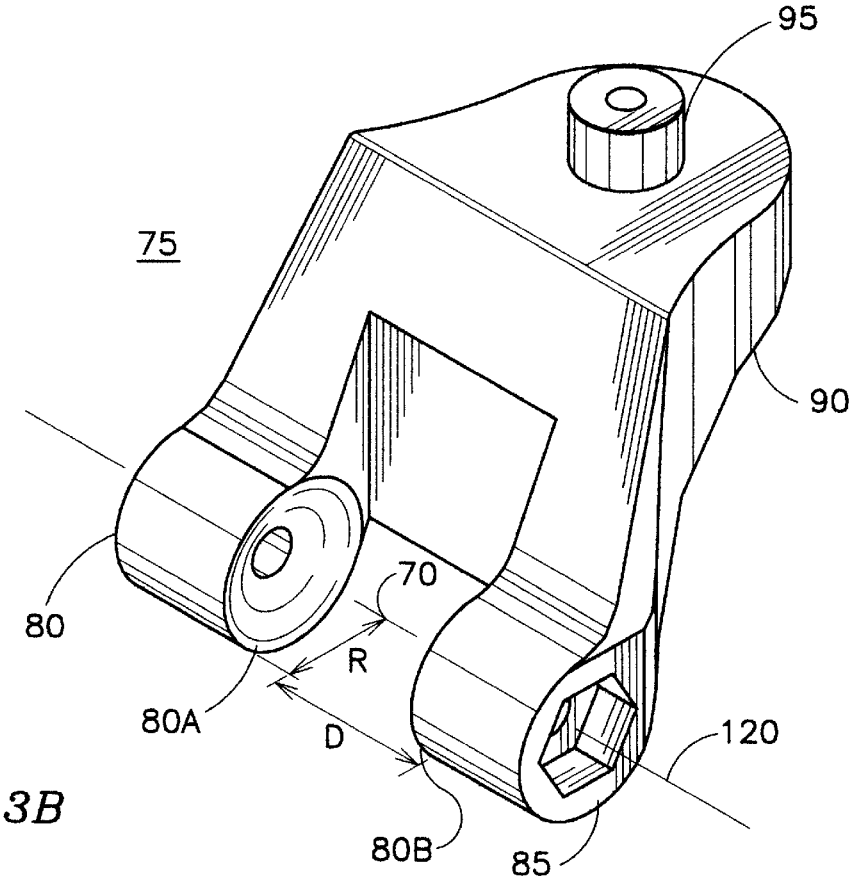
FIG. 3B is a right perspective view of the first hinge member of the hinge assembly.

FIGS. 3A and 3B are left and right perspective views, respectively, of first hinge member 75. First hinge member 75 includes arms 80 and 85 for receiving pivot head 55 therebetween. Arms 80 and 85 are spaced sufficiently apart so that pivot head 55 can be seated between arms 80 and 85. Arms 80 and 85 include interior end surfaces 80A and 85A, respectively, which are concavely shaped to mate with the convex surfaces of pivot head ends 55A and 55B. Coaxially aligned holes 87 and 89 are situated in arms 80 and 85 as show. Holes 87 and 89 capture a hinge pin which passes therethrough as discussed later.

First hinge member 75 includes a base member 90 from which arms 80 and 85 extend as shown in FIGS. 3A and 3B. First hinge member 75 also includes a mounting pin 95 including a threaded hole for receiving a mounting screw 96 (see FIG. 1B) for attaching member 75 to window pane 10 through a mounting hole in the window.

Figure 4A:
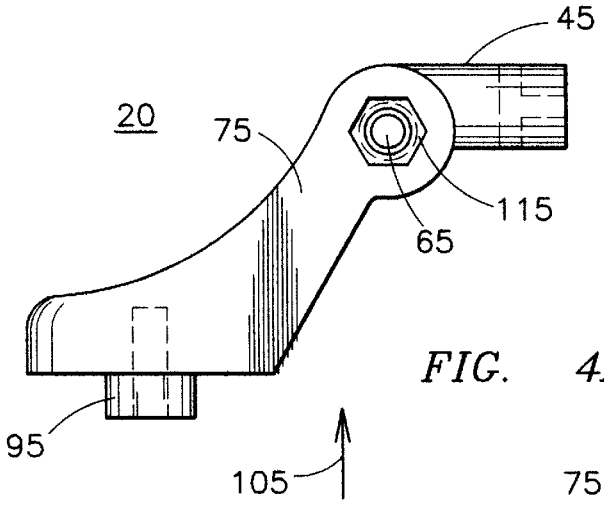
FIG. 4A is a side view of the hinge assembly showing the second hinge member and the first hinge member oriented in the window-open position.

FIG. 4A is a side view of the hinge assembly 20 including second hinge member 45 and first hinge member 75 positioned in the window-open position. From the above it will be appreciated that second hinge member 45 is mounted to a stationary frame such as a ship's hull while the mating first hinge member 75 is mounted to the interior surface 10 of window 10. The pivot head 55 of second hinge member 45 is situated between arms 80 and 85 of first hinge member 75 as shown.

Figure 4B:
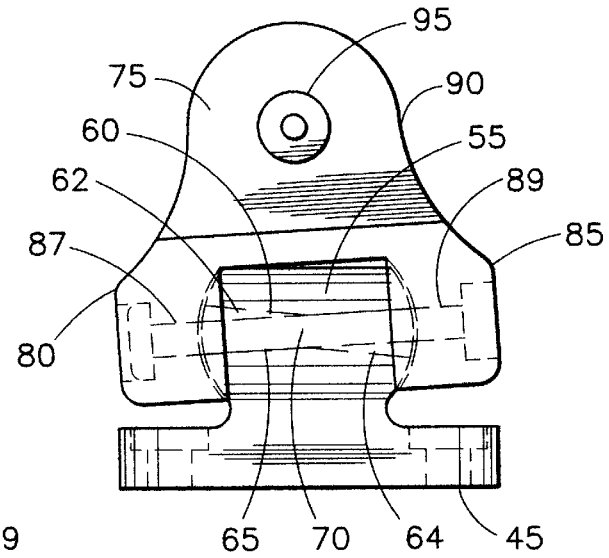
FIGS. 4B–4D are bottom views of the hinge assembly of FIG. 4A showing various angular positions that the hinge pin in the first hinge member can assume with respect to the pivot chamber of the second hinge member.
Figure 4C:
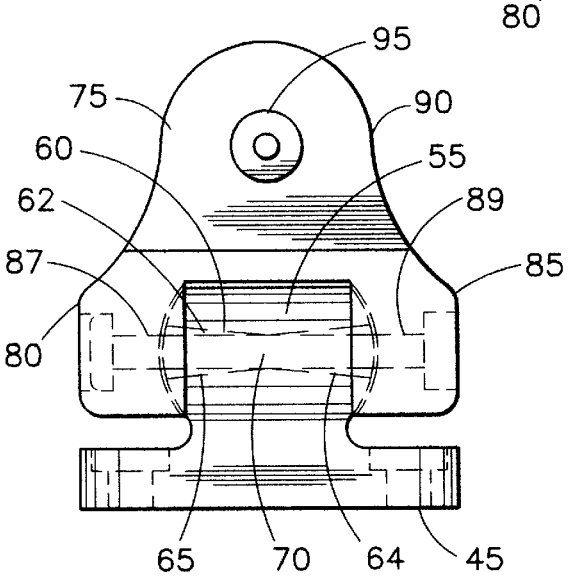
Figure 4D:
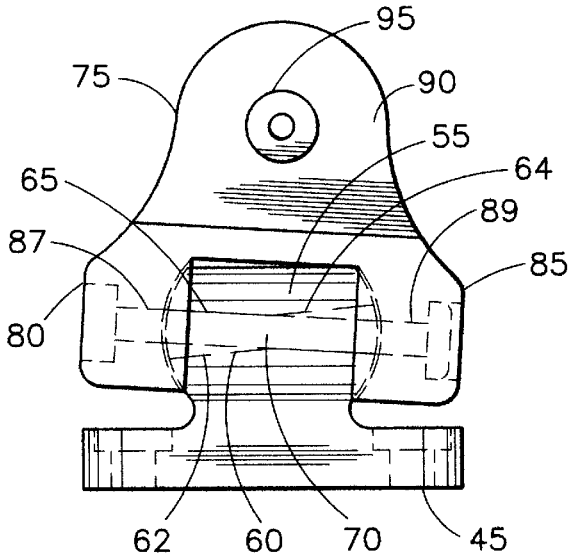

Hinge pin 65 is situated extending through arm hole 87, through pivot chamber 60 and through arm hole 89 to hold second hinge member 45 to first hinge member 95 as shown in FIG. 4B–4D. (FIG. 4B–4D are illustrated from the perspective of an observer looking at the bottom of hinge 20 of FIG. 4A in the direction of arrow 105.) FIGS. 4B–4D show the varying angular positions which hinge pin 65 can assume within pivot chamber 60 to prevent binding of the hinges 20 and 30 as window 10 moves. Cone-shaped chamber sections 62 and 64 control the amount of axial rotation permitted about pivot point 70 within pivot chamber 60. The wider the open ends of the cones, the greater the amount of axial rotation permitted.

Figure 5A:
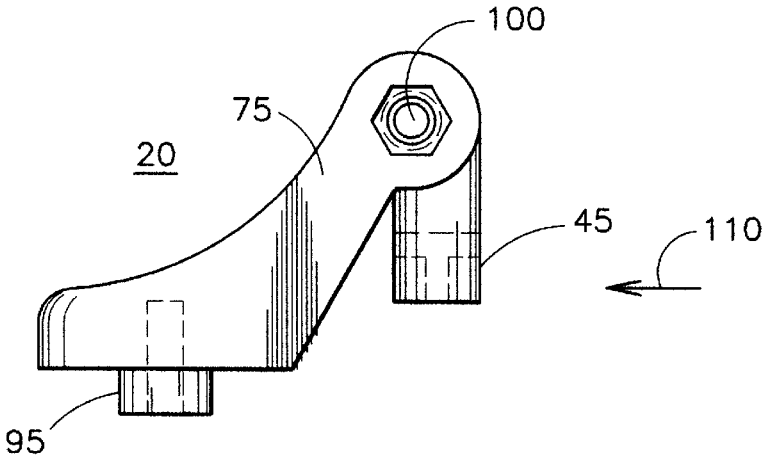
FIG. 5A is a side view of the hinge assembly showing the second hinge member and the first hinge member oriented in the window-closed position.
Figure 5B:
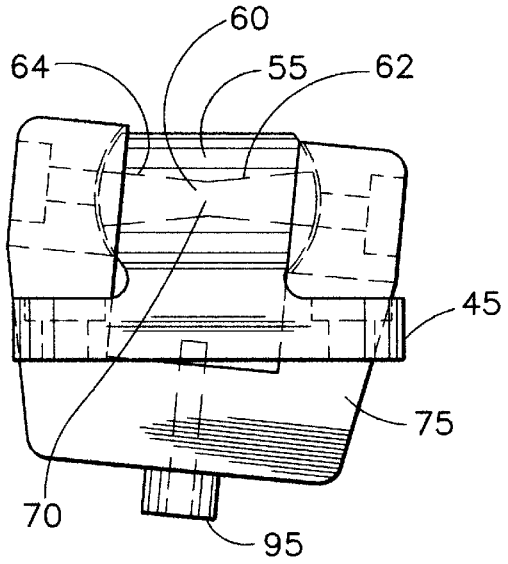
FIGS. 5B–5D are side views of the hinge assembly of FIG. 5A showing various angular positions that the first hinge member can assume with respect to the pivot chamber of the second hinge member.
Figure 5C:
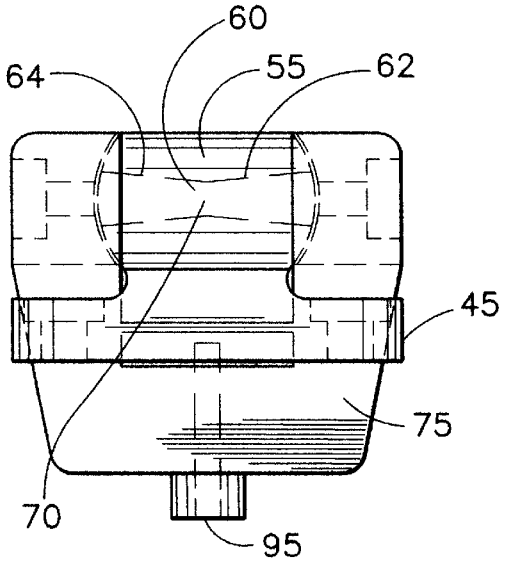
Figure 5D:
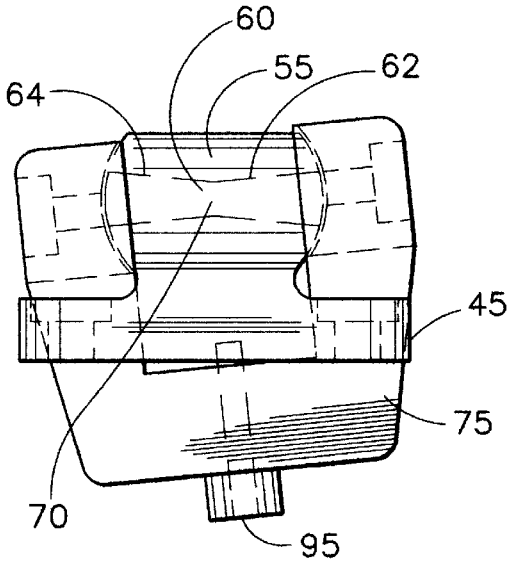

FIG. 5A is a side view of hinge assembly 20 including second hinge member 45 and first hinge member 75 positioned in the window-closed position. FIGS. 5B–5D show the varying angular positions which second hinge member 45 can assume with respect to first hinge member 75 to prevent binding of hinges 20 and 30 on window 10. For clarity, hinge pin 65 is not shown in FIGS. 5B–5D. (FIG. 5B–5D are illustrated from the perspective of an observer looking at the side of hinge 20 of FIG. 5A in the direction of arrow 110.) Again, cone-shaped chamber sections 62 and 64 control the amount of rotation of hinge pin 65 about pivot point 70 within pivot chamber 60.

Together second hinge member 45, hinge pin 65 and first hinge member 75 form hinge assembly 20. The same component arrangement forms hinge assembly 30. Hinge pin 65 is situated in an axially fixed position within first hinge member by one of several techniques. In one embodiment shown in FIG. 4B, one of the arm holes 87 or 89 is threaded to receive a threaded end of the hinge pin 65 therein. Alternatively, the holes 87, 89 are unthreaded and the hinge pin 65 has a threaded end which extends beyond the arm-hole 87, 89 and threads into a nut 115 as shown in FIG. 4A. In either case, tightening of the hinge pin pulls the arms 80, 85 towards each other and into clamping position on pivot head 55 to thereby provide adjustable friction fitting between the two hinge members 45 and 75.

Accordingly, as seen in FIG. 3B, the axis 120 of hinge pin 65 is fixed with respect to first hinge member 75. However, as seen in FIG. 2C., the angle between axis 120 of hinge pin 65 and the central lateral axis 125 of pivot chamber 60 varies as hinge pin 65 axially pivots about pivot point 70 of pivot head 55. This pivoting action is referred to as "axial pivoting". Arrows 66 and 68 show possible directions of such axial pivoting. Pivot head 55 can also axially pivot in directions opposite to those indicated by arrows 66 and 68 and other directions as well about central pivot point 70.

It is noted that the inner diameter of pivot head 55 where cone-shaped chamber sections 62 and 64 meet is approximately the same as the diameter of hinge pin 65. This permits hinge pin 65 to pass through pivot chamber 60 and to axially pivot about pivot point 70 which is formed where cone-shaped chamber sections 62 and 64 meet. The above-described "axial pivoting" action is to be distinguished from the "radially pivoting" action of pivot head 55 with respect to first hinge member 75 (not shown in FIG. 2C) as indicated by arrow 69.

As seen in FIG. 3B, the common radius of convex interior end surfaces 80A and 80B is defined as R. In one embodiment, radius R equals the distance, D, between the center of the hinge (pivot point 70) and the convex end surfaces 80A and 80B.

The foregoing has described a hinge arrangement for a marine window wherein second and first portions of the hinge can assume varying angular positions as the marine window opens and closes. More particularly, the first hinge member can pivot both radially and axially with respect to the second hinge member. In this manner, binding of hinges in a two hinge marine window hinge arrangement is advantageously avoided. Moreover, hinge breakage upon repeated use is significantly reduced.

While only certain preferred features of the invention have been shown by way of illustration, many modifications and changes will occur to those skilled in the art. For example, while the particular window on which the hinges are employed in the above description exhibits a substantially elliptical shape, the hinges can also be readily employed to prevent binding of windows with other geometries wherein the window includes a curved surface adjacent the hinges. Oval windows and circular window are some examples of such windows on which the disclosed hinges can be employed. It is, therefore, to be understood that the present claims are intended to cover all such modifications and changes which fall within the true spirit of the invention.

What is claimed is:

1. A hinge assembly comprising:

a hinge pin;

a first hinge member for holding the hinge pin in an axially fixed position with respect to the first hinge member; and a second hinge member including a pivot head having a pivot chamber with opposed ends and a mid portion between the opposed ends, the pivot head being adapted for extending within the first hinge member such that the hinge pin passes through the pivot chamber, the pivot chamber exhibiting a geometry which is narrower toward the mid portion of the pivot chamber than the opposed ends of the pivot chamber to form a pivot point at the mid portion of the pivot chamber so that the hinge pin and the first hinge member pivot radially and axially about the pivot point as the first hinge member is pivoted with respect to the second hinge member, the pivot chamber including first and second cone-shaped sections, the first cone-shaped section extending from the mid portion to one of the opposed ends of the pivot chamber, the second cone-shaped section extending from the mid portion to the other of the opposed ends of the pivot chamber.

2. The hinge assembly of claim 1 wherein the first hinge member includes first and second arms between which the pivot head of the second hinge member is captured.

3. The hinge assembly of claim 2 wherein the pivot head exhibits a substantially cylindrical shape with first and second convexly-shaped opposed end surfaces.

4. The hinge assembly of claim 3 wherein the first and second arms of the first hinge member include first and second concavely-shaped interior surfaces which face each other and mate with the first and second convexly-shaped opposed end surfaces, respectively, of the pivot head.

5. The hinge assembly of claim 2 wherein the first hinge member includes a first base member from which the first and second arms extend.

6. The hinge assembly of claim 5 wherein the first base member of the first hinge member includes a window mounting structure for attaching the hinge assembly to a window.

7. The hinge assembly of claim 2 wherein the second hinge member includes a second base member from which the pivot head extends.

8. The hinge assembly of claim 7 wherein the second base member of the second hinge member includes a frame mounting structure for attaching the hinge assembly to a frame.

9. A hinge assembly comprising:

a hinge pin;

a first hinge member including a first base member from which first and second arms extend to hold the hinge pin in an axially fixed position in the first hinge member; and a second hinge member including a second base member and a pivot head extending from the second base member, the pivot head including a pivot chamber with opposed ends and a mid portion between the opposed ends, the pivot head being situated extending within the first hinge member such that the hinge pin passes through the pivot chamber, the pivot chamber exhibiting a geometry which is narrower toward the mid portion of the pivot chamber than the opposed ends of the pivot chamber to form a pivot point at the mid portion of the pivot chamber so that the hinge pin and the first hinge member pivot radially and axially about the pivot point, the pivot chamber including first and second cone-shaped sections, the first cone-shaped section extending from the mid portion to one of the opposed ends of the pivot chamber, the second cone-shaped section extending from the mid portion to the other of the opposed ends of the pivot chamber.

10. The hinge assembly of claim 9 wherein the pivot head of the second hinge is situated between the first and second arms of the first hinge member.

11. The hinge assembly of claim 10 wherein the pivot head exhibits a substantially cylindrical shape with first and second convexly-shaped opposed end surfaces.

12. The hinge assembly of claim 11 wherein the first and second arms of the first hinge member include first and second concavely-shaped interior surfaces which face each other and mate with the first and second convexly-shaped opposed end surfaces, respectively, of the pivot head.

13. The hinge assembly of claim 9 wherein the first base member of the first hinge member includes a window mounting structure for attaching the hinge assembly to a window.

14. The hinge assembly of claim 9 wherein the second base member of the second hinge member includes a frame mounting structure for attaching the hinge assembly to a frame.

15. A window assembly comprising:

a window including a first curved edge surface;

a frame including an opening having a second curved edge surface located adjacent the first curved edge surface of the window;

first and second hinge assemblies situated in spaced apart relationship and connecting the window to the frame adjacent the first and second curved edge surfaces, the first and second hinge assemblies each including:

a hinge pin;

a first hinge member for holding the hinge pin in an axially fixed position in the first hinge member; and a second hinge member including a pivot head having a pivot chamber with opposed ends and a mid portion between the opposed ends, the pivot head being situated extending within the first hinge member such that the hinge pin passes through the pivot chamber, the pivot chamber exhibiting a geometry which is narrower toward the mid portion of the pivot chamber than the opposed ends of the pivot chamber to form a pivot point at the mid portion of the pivot chamber so that the hinge pin and the first hinge member pivot radially and axially about the pivot point, the pivot chamber including first and second cone-shaped sections, the first cone-shaped section extending from the mid portion to one of the opposed ends of the pivot chamber, the second cone-shaped section extending from the mid portion to the other of the opposed ends of the pivot chamber.

16. The window assembly of claim 15 wherein the window comprises an elliptically shaped window.

17. The window assembly of claim 15 wherein the window comprises a circularly shaped window.

* * * * *